US012269995B1

(12) United States Patent
Manriquez

(10) Patent No.: US 12,269,995 B1
(45) Date of Patent: Apr. 8, 2025

(54) TREATMENT COMPOSITIONS AND METHODS OF USING SAME FOR REMEDIATING MERCAPTANS AND SULFUR COMPOUNDS IN HYDROCARBON LIQUIDS

(71) Applicant: GAPS Technology, LLC, Slidell, LA (US)

(72) Inventor: Ruby Manriquez, New Orleans, LA (US)

(73) Assignee: GAPS Technology LLC., Slidell, LA (US)

( * ) Notice: Subject to any disclaimer, the term of this patent is extended or adjusted under 35 U.S.C. 154(b) by 0 days.

(21) Appl. No.: 18/769,855

(22) Filed: Jul. 11, 2024

Related U.S. Application Data

(63) Continuation of application No. 18/679,938, filed on May 31, 2024.

(60) Provisional application No. 63/538,586, filed on Sep. 15, 2023.

(51) Int. Cl.

| | |
|---|---|
| ***C10G 29/20*** | (2006.01) |
| ***C10G 29/06*** | (2006.01) |
| ***C10G 29/22*** | (2006.01) |

(52) U.S. Cl.
CPC ..... *C10G 29/20* (2013.01); *C10G 29/06* (2013.01); *C10G 29/22* (2013.01); *C10G 2300/207* (2013.01)

(58) Field of Classification Search
CPC ..... C10G 29/20; C10G 29/06; C10G 29/22; C10G 2300/207
See application file for complete search history.

(56) References Cited

U.S. PATENT DOCUMENTS

2013/0172623 A1* 7/2013 Kaplan ..... C10L 3/103 585/860
2022/0290055 A1* 9/2022 Jin ..... C09K 8/54

* cited by examiner

*Primary Examiner* — Randy Boyer
*Assistant Examiner* — Juan C Valencia
(74) *Attorney, Agent, or Firm* — Carrier, Shende & Associate P.C.; Joseph P. Carrier; Fulchand P. Shende

(57) ABSTRACT

A liquid treatment composition for remediating and removing mercaptans from contaminated hydrocarbon liquids, the treatment composition including a hydrocarbon liquid, at least one alkoxide compound, and at least one terpene. A collective content of the at least one alkoxide compound in the liquid treatment composition is in a range of 1-20 wt % weight, a collective content of the at least one terpene in the liquid treatment composition is 5-25 vol %, a content of the hydrocarbon liquid in the treatment solution is 50-90 vol %.

11 Claims, No Drawings

TREATMENT COMPOSITIONS AND METHODS OF USING SAME FOR REMEDIATING MERCAPTANS AND SULFUR COMPOUNDS IN HYDROCARBON LIQUIDS

CROSS-REFERENCE TO RELATED APPLICATIONS

This application is a Continuation of U.S. patent application Ser. No. 18/679,938, filed May 31, 2024, which claims priority to U.S. Provisional Application Ser. No. 63/538,586, filed Sep. 15, 2023. The entire subject matter of this priority application is incorporated by reference herein.

BACKGROUND OF THE INVENTION

1. Field of the Invention

The present disclosure pertains to innovative treatment compositions and methods designed for the remediation of sulfur-containing contaminants, including mercaptans (thioalcohols), from hydrocarbon-based liquids such as crude oil and its refined products. Specifically, this disclosure focuses on advanced treatment compositions and methods that effectively and economically dissociate contaminants including mercaptans into sulfur and organic substances.

2. Background

Sulfur-containing compounds including hydrogen sulfide ($H_2S$), mercaptans, thiophenes, etc. have long been recognized as undesirable contaminants in contaminated fluids, particularly in hydrocarbon fluids such as crude oil and natural gas. $H_2S$ is a particularly undesirable contaminant because it is highly toxic, corrosive, etc. and generally hydrocarbon fluids should contain less than five ppm $H_2S$. However, even when there is little $H_2S$ in a given hydrocarbon liquid, the liquid may contain significant amounts of other sulfur-containing contaminants such as thioalcohols which must be remediated down to acceptable levels to make the hydrocarbon liquid more valuable and usable.

Mercaptans are complex organic molecules having a general formula R—S—H in which sulfur is bound to a solvent, alcohol or other organic substances commonly referred to as aromatic compounds which may have a relatively high vapor pressure. There are many known species of mercaptans, which are also known as thioalcohols, including methyl mercaptan, ethyl mercaptan, isopropyl mercaptan, tert-butyl mercaptans and iso-butyl mercaptan to name a few. Mercaptans are commonly found in crude oil, which has a slightly acidic pH of 5.8 to 6.2 and may be released from the crude oil as acidic gases or vapors that are highly damaging to metal infrastructure. These acid gasses must controlled through containment, venting and scrubbing the acidic gasses from the vented gasses and vapors before the gasses and vapors are released into the atmosphere. In crude oil, mercaptans undergo oxidation to form more stable disulfides (R—S—S—R).

Mercaptans cannot be removed by distillation or amine treatment, but for liquids such as crude oil there are two conventional treatment options for treating mercaptans respectively known as extraction and sweetening, each of which involves oxidizing the mercaptans into disulfides. In a conventional extraction treatment, after the mercaptans have been oxidized into disulfides the disulfides are dissolved or extracted into an aqueous based caustic solution and thereby removed from the crude oil or other hydrocarbon based liquid being treated. Subsequently the disulfides may be precipitated and removed from the caustic solution, and the caustic solution may then be reused. In a conventional sweetening treatment, the mercaptans that have been oxidized into disulfides are left in the treated liquids. Extraction is typically used for lighter hydrocarbon products such as light naphtha and sweetening is typically used for heavier hydrocarbon products such as gasoline and diesel fuel.

One common form of extraction is done subsequent to distillation of crude oil into different fractions and is performed using a system/method known as a merox unit. Merox is an acronym for mercaptan oxidation. It is a proprietary catalytic chemical process developed by UOP used in oil refineries and natural gas processing plants to remove mercaptans from LPG, propane, butanes, light naphthas, kerosene and jet fuel by converting them to liquid hydrocarbon disulfides. One disadvantage of merox is that different merox treatment systems/methods must be applied to the different fractions of the distilled crude oil, which leads to increased size and cost. Also, different countries have different requirements regarding the permitted content of mercaptans in crude oil acceptable for distillation, e.g., while the US permits relative higher contents of mercaptans above 100 ppm, many foreign nations will not accept crude oil for distillation if it contains more than 75 ppm of mercaptans. The conventional treatment processes are generally effective for remediating and possibly removing mercaptans from crude oil and other liquids, but the conventional processes remain to be improved on in terms of effectiveness and cost efficiency.

Hence, it still remains a great need in the art for a treatment composition/treatment process that is capable of quickly remediating mercaptans in contaminated hydrocarbon based liquids down to appropriate, safe levels in a practical, cost effective manner.

SUMMARY OF THE INVENTION

An object of the present invention is to satisfy the above needs in the art.

The present inventor has carefully studied the treatment of contaminated hydrocarbon based liquids containing relatively high concentrations of mercaptans, and has discovered new treatment compositions and treatment processes which are very effective, efficient and economically practical for quickly remediating and/or removing most of the mercaptans in such hydrocarbon based liquids down to safe, acceptable levels in an efficient, cost-effective manner.

A first aspect and embodiment of the present invention pertains to a new liquid based treatment composition, which includes little or no water, and is effective at efficiently remediating the mercaptans and other contaminants, including hydrogen sulfide and sulfur, in liquids such as crude oil and fractions of other liquids obtained through distillation of crude oil. The new liquid treatment composition primarily includes at least one organic or hydrocarbon liquid as a base, together with one or more hydroxide compounds, at least one terpene, and possibly some water. Optionally, the treatment composition may include smaller amounts of an organic acid such as fulvic acid and humic acid, and/or a chelating agent such as ethylenediaminetetraacetic acid (EDTA).

A treatment process involving the new liquid treatment composition may simply involve adding an appropriate dosage of the new treatment composition per unit of the contaminated liquid being treated, e.g., 5 to 4000 parts per million (ppm)/liter or other quantity of contaminated liquid being treated, with the specific dosage amount based on the type of contaminated liquid being treated and the types and amounts of mercaptans and other contaminants in the contaminated liquid which are to be remediated. Distillates of crude oil not only have lower viscosity than the crude oil, but any mercaptans in the distillates will typically be lower molecular weight mercaptans. Correspondingly, dosage rates for treating distillates will generally be lower than the dosage rates for treating crude oil.

Hydroxides including sodium hydroxide (NaOH) and potassium hydroxide (KOH) are strong bases that can deprotonate the hydrogen atoms attached to sulfur in mercaptans (thiols). This forms water-soluble salts, known as mercaptides. Organic solvents including alcohols such as methanol, ethanol and 1-propanol, which can be used as the organic or hydrocarbon liquid base of the new treatment composition, can extract the water-soluble mercaptides formed in the reaction between the mercaptans and hydroxides. These alcohols can dissolve the mercaptides and separate them from the crude oil. The terpenes in the treatment composition interact with the remaining odor compounds in the contaminated hydrocarbon based liquids.

The new treatment composition according to the first aspect and embodiment of the present invention may contain: 50-90 vol % of organic solvent base, which may include one or more alcohol and/or other polar and non-polar hydrocarbon based liquids as discussed herein; 1-15 wt % collectively of one or more hydroxide compound; and 5-15 vol % of one or more terpenes. Optionally, the treatment composition may also include 0.01 to 2.0 wt % collectively of organic acids such as fulvic acid and humic acid; and/or 0.1 to 2.0 weight % of a chelating agent such as ethylenediamine tetraacetic acid (EDTA). The treatment composition may contain some water, e.g., ≤15 vol %, but preferably contains little or no water. The organic acids such as fulvic acid and humic acid are helpful to prevent precipitates from being released from the treated liquids, which is desirable to avoid blockages of the treatment system. The chelating agent such as EDTA is helpful to enhance the reaction between the hydroxide compound(s) and the mercaptans in the contaminated liquids such as crude oil and distillation fractions of crude oil.

According to a second aspect and embodiment of the present invention, there is provided another new liquid based treatment composition which is somewhat different from the liquid composition and according to the first aspect and embodiment of the present invention, but also very effective at remediating mercaptans, and other contaminants, including hydrogen sulfide, sulfur and metals, in liquids including crude oil and distillates of crude oil. This new liquid based treatment composition also uses an organic or hydrocarbon liquid base and is also very effective at efficiently remediating the mercaptans in liquids such as crude oil and fractions of other liquids obtained through distillation of crude oil similar to the treatment composition according to the first aspect of the present invention. A primary difference between this new treatment composition and the treatment composition according to the first discovery is the use of at least one alkoxide rather than at least one hydroxide compound as the primary reactant for remediating the mercaptans and other targeted contaminants in contaminated liquids such as crude oil and distillates of crude oil. Some appropriate alkoxides include sodium methoxide ($CH_3NaO$), sodium ethoxide ($C_2H_5ONa$), potassium methoxide ($CH_3KO$), potassium ethoxide ($C_2H_5$ $C_2H_5KO$), etc., and combinations of two or more of these alkoxides.

The new liquid treatment composition according to the second aspect and embodiment primarily includes at least one hydrocarbon/organic liquid as a base, together with one or more alkoxide compounds, and at least one terpene. The liquids used as the hydrocarbon liquid base and as the terpenes may be the same as discussed herein in relation to the treatment composition according to the first aspect and embodiment of the present invention, while the alkoxide(s) may be as discussed above. This treatment composition preferably includes no water, noting that water may react with sodium methoxide and other alkoxides thereby detracting from the reaction between the alkoxides and mercaptans, and may cause some contaminants including salts to precipitate out of the contaminated liquid being treated. Otherwise, it is generally undesirable to have any significant amount of water in crude oil and distillates of crude oil. In this treatment composition according to the second aspect and embodiment of the present invention the alkoxide compounds may be directly dissolved in the hydrocarbon liquid base, which is advantageous as the composition preferably includes no water.

The new treatment composition according to the second aspect and embodiment may contain: 50-90 vol % or wt % of organic liquid base; 1-20 wt % collectively of one or more alkoxide compound; and 5-20 vol % collectively of one or more terpene. Optionally, the treatment composition according to the second aspect of the present invention may also include a small amount of an organic acid such as fulvic acid and humic acid, e.g., 0.01 to 2.0 wt % collectively, which may help to prevent release of any precipitates from the treated liquid.

The inventor has determined that in comparison to hydroxide compounds, alkoxides exhibit superior efficacy in mitigating thiol mercaptans in crude oil and petroleum due to their heightened reactivity and specificity towards mercaptans, resulting in the formation of water soluble sodium salts. For example, if sodium methoxide is used in this new treatment composition, the sodium methoxide reacts with mercaptans in crude oil to form sodium methyl mercaptide ($CH_3SNa$), a water-soluble sodium salt, as a byproduct, while other alkoxides react with various mercaptans to form other mercaptides. This reaction involves the substitution of the hydrogen atom in the thiol molecule with a sodium atom from the sodium methoxide. Although the new treatment composition according to the second aspect and embodiment of the present invention preferably includes no water, crude oil may contain some water, e.g., ≤1 vol %. Sodium mercaptide, is soluble in water due to the presence of the sodium ion, which has a strong affinity for water molecules, and to any extent that there is some water in the crude oil the water may contain the sodium mercaptide in solution so that it does not precipitate out of the treated crude oil. Due to their solubility in water sodium mercaptide and other mercatides are also easily separable from any hydrocarbon liquid being treated, such as crude oil and distillates thereof.

Additionally, the treatment composition according to the second aspect and embodiment of the present invention is also effective at reducing total sulfur, oxygenates and some metals, including iron and nickel, from contaminated liquids such as crude oil and distillates of crude oil.

The inventor has also determined that while a range of alkoxide concentrations are appropriate for use in the treatment composition according to the second aspect of the present invention, higher concentrations of the alkoxides within the discussed range may provide better results. For example, a treatment composition including 80 vol % methanol and 10 vol % 1-propanol base having sodium methoxide dissolved in the base liquid at a concentration of 35% w/v, and 10 vol % of limonene demonstrates enhanced efficacy in mitigating thiols within crude oil compared to the same treatment composition using treatment compositions with lower concentrations of sodium methoxide, such as 15% or 20% w//v in the hydrocarbon base liquid. This higher concentration facilitates a more robust reaction with mercaptans leading to improved removal efficiency and overall performance.

A treatment process using the new liquid treatment composition according to the second aspect and embodiment of the present invention is very similar to the treatment process according to the liquid treatment composition according to the first aspect and embodiment of the present invention as it essentially involves adding an appropriate dosage of the new liquid treatment composition to a contaminated liquid and allowing the treatment composition to react with the mercaptans and other contaminants in the treated liquid over a period of time, e.g., a dosage rate of 5 to 4000 ppm of contaminated crude oil or other liquid being treated, with the specific amount based on the type of contaminated liquid being treated and the types and amounts of mercaptans and other contaminants to be remediated in the liquid being treated.

INTENT OF DISCLOSURE

Although the following disclosure offered for public dissemination is detailed to ensure adequacy and aid in understanding of the invention, this is not intended to prejudice that purpose of a patent which is to cover each new inventive concept therein no matter how it may later be disguised by variations in form or additions of further improvements. The claims at the end hereof are the chief aid toward this purpose, as it is these that meet the requirement of pointing out the improvements, combinations and methods in which the inventive concepts are found.

DETAILED DESCRIPTION OF PRESENT EXEMPLARY EMBODIMENTS

In the following, details of new treatment solutions and treatment processes involving use of the of new treatment solutions according to exemplary embodiments of the present invention are presented, as well as specific examples of contaminated liquids that are treated using the new treatment solutions and processes.

First Embodiment According to a first aspect and embodiment of the present invention there is provided a new liquid based treatment composition, which includes little or no water, and is effective at efficiently remediating the mercaptans and other contaminants, including hydrogen sulfide and sulfur, in liquids such as crude oil and fractions of other liquids obtained through distillation of crude oil. The new liquid treatment composition primarily includes at least one organic or hydrocarbon liquid as a base, together with one or more hydroxide compounds, at least one terpene. Optionally, the treatment composition may include smaller amounts of an organic acid such as fulvic acid and humic acid, and/or a chelating agent such as ethylenediaminetetraacetic acid (EDTA). The treatment composition may also include some water, but preferably contains little or no water. A treatment process involving the new liquid treatment composition may simply involve adding an appropriate dosage of the new treatment composition per unit of the contaminated liquid being treated, e.g., 5 to 4000 ppm of treatment composition/liter or other amount of contaminated liquid being treated, with the specific dosage amount based on the type of contaminated liquid being treated and the types and amounts of mercaptans and other contaminants in the contaminated liquid which are to be remediated. Distillates of crude oil not only have lower viscosity than the crude oil, but any mercaptans in the distillates will typically be lower molecular weight mercaptans. Correspondingly, dosage rates for treating distillates will generally be lower than the dosage rates for treating crude oil.

Hydroxides including sodium hydroxide (NaOH) and potassium hydroxide (KOH) are strong bases that can deprotonate the hydrogen atoms attached to sulfur in mercaptans (thiols). This forms water-soluble salts, known as mercaptides. Organic solvents including alcohols such as methanol, ethanol and 1-propanol, which can be used as the organic or hydrocarbon liquid base of the new treatment composition, can extract the water-soluble mercaptides formed in the reaction between the mercaptans and hydroxides. These alcohols can dissolve the mercaptides and separate them from the crude oil. The terpenes in the treatment composition interact with the remaining odor compounds in the contaminated hydrocarbon based liquids.

A wide variety of polar and non-polar hydrocarbon based liquids may be used in the new treatment compositions, including relatively low molecular weight liquid(s) including alcohols, hexane, and others, as well as mixtures of these liquids, provided that the hydroxide compound(s) and any other components to be included in the treatment compositions may be fully dissolved or dispersed into the hydrocarbon based liquids. Alcohols are appropriate for use as the hydrocarbon liquids because they are polar so that other components of the treatment composition(s) are generally dissolvable and/or miscible therein. Lighter alcohols, including methanol ($CH_3OH$), ethanol ($C_2H_5OH$), and 1-propyl alcohol ($C_3H_8O$), may be more appropriate based on lower cost and/or higher vapor pressure. N,n-dimethylformamide ($HCON(CH_3)_2$) and dimethylacetamide ($CH_3CN(CH_3)_2$ and other similar organic liquids are also appropriate as the hydrocarbon liquids used in the treatment compositions according to the present invention.

The inventor has determined through experimentation that different organic liquid bases may help achieve the best remediation results depending on the particular contaminated liquid is being treated and the particular types and amounts of mercaptans and other contaminants are contained in contaminated liquid. The inventor has also determined that a mixture of organic liquids as a base of the treatment composition, e.g., a blend containing amounts of both methanol and ethanol, may provide a more efficient remediation of the mercaptans in a given contaminated liquid, noting that a mixture of hydrocarbon base liquids capitalizes on the speciation variances among the mercaptan/thiol contaminants to be remediated. For example if a crude oil contains a significant amount of ethyl thiols, in such cases inclusion of ethanol as well as methanol in the organic liquid base of the treatment composition introduces supplementary reaction pathways for mercaptan conversion.

Also, these organic liquids have relatively high vapor pressures, which is desirable because more of the reactive hydroxide compound(s) may be contained in the vapors released from the liquids being treated compared to liquids having lower vapor pressures. The vapors of the organic liquid bases will contain some of the hydroxide compound (s) in the treatment composition, and the hydroxides in the vapors can better react with gaseous contaminants including $H_2S$ and $CO_2$ which may be released from the crude oil or other liquids being treated, and may collect in a head space of a container in which the crude oil is disposed. The new treatment composition is effective for remediating mercaptans in hydrocarbon based liquids at standard temperature and pressure, but the remediation reaction(s) can be performed at elevated temperatures and will typically proceed more quickly at elevated temperatures.

There are many different terpenes that can be used in the treatment compositions of the present invention. These include limonene ($C_{10}H_{16}$) which comes in different forms, e.g., R-Limonene/d-Limonene, r-carvone, linalool, citronellal, myrcene, menthol, geraniol, pinene, linalool, and artemisinin-a, which is a terpene peroxide. The treatment composition according to the present invention may use any of the different terpenes or mixtures of the terpenes, as well as different forms of some terpenes, e.g., r-limonene and d-limonene, but some terpenes are less expensive than others, and if used can lower costs of the treatment process. The reaction between the terpenes and mercaptans in crude oil involves the oxidation of the mercaptans by the terpenes' functional groups, e.g., the double bonds, which may lead to the formation of various products, including disulfides and other sulfur containing compounds. The specific reaction products and mechanisms can vary depending on the conditions, such as temperature, pressure, presence of catalysts, and the composition of the crude oil, including the different contaminants and amounts of the different contaminants in the crude oil.

Generally, all hydroxide compounds may be used provided they can be dissolved or dispersed in the hydrocarbon liquid(s) of the new treatment composition. Some typical hydroxide compounds that may be used in the new treatment compositions include sodium hydroxide (NaOH), potassium hydroxide (KOH), lithium hydroxide (LiOH), magnesium hydroxide ($Mg(OH)_2$), manganese hydroxide ($Mn(OH)_2$, $Mn(OH)_4$) and ammonium hydroxide ($NH_4OH$). However, some hydroxide compounds have lower cost, e.g., NaOH and KOH, and if used may make the composition and treatment processes using the composition more economically advantageous. Sodium hydroxide is typically more effective for remediating mercaptans in comparison to potassium hydroxide. However, if the treatment composition is to be used with fluids such as crude oil which include significant amounts of NaCl, which will typically be dissolved in any water included in the fluids, it may be desirable to use little or no NaOH to help prevent causing any salt to precipitate out of the treated fluids.

Although the new treatment composition according to the first embodiment of the present invention preferably includes little or no water, if there is any water in the treatment composition it may be used as a medium into which the hydroxide compound(s), the organic acid(s) and the chelating agent may be initially dissolved before being added to the organic solvent base. It is desirable that all components of the new treatment composition apart from the hydrocarbon base liquid should be dissolvable, dispersible and/or miscible in the hydrocarbon base liquid.

The new treatment composition according to the first aspect and embodiment of the present invention may contain: 50-90 vol % of organic solvent base, which may include one or more alcohol and/or other polar and non-polar hydrocarbon based liquids as discussed herein; 1-15 wt % collectively of one or more hydroxide compound; and 5-15 vol % of one or more terpenes. Optionally, the treatment composition may also include 0.01 to 2.0 wt % collectively of organic acids such as fulvic acid and humic acid; and/or 0.1 to 2.0 weight % of a chelating agent such as ethylenediamine tetraacetic acid (EDTA). The treatment composition may contain some water, e.g., ≤15 vol %, but preferably contains little or no water. The organic acids such as fulvic acid and humic acid are helpful to prevent precipitates from being released from the treated liquids, which is desirable to avoid blockages of the treatment system. The chelating agent such as EDTA is helpful to enhance the reaction between the hydroxide compound(s) and the mercaptans in the contaminated liquids such as crude oil and distillation fractions of crude oil.

In one example of a treatment process according to the first aspect and embodiment of the present invention, a crude oil sample having a relatively high mercaptans content was treated with a treatment composition according to the present invention as follows. The crude oil sample was obtained from a well in Texas and its mercaptans content was determined using UOP 163, a testing method used to determine the content of RSH and $H_2S$ in hydrocarbons by potentiometric titration. The sample was homogenized then titrated for the 'neat' sample content of RSH, 820.969 ppm, and $H_2S$ content of 37.508 ppm. RHS is a measure of total mercaptans content. The treatment composition used in this example contained 60 vol % of methanol 10 vol % of 1-propanol, 10 vol % of an aqueous solution containing about 50 wt % of NaOH, 10 vol % of an aqueous solution containing about 45 wt % of KOH, 9 volume % of a mixture of r-limonene/d-limonene; and 1 vol % of an aqueous solution containing about 4 wt % of fulvic acid. The sample was treated at a dosing rate which achieved 2,000 ppm treatment composition in the contaminated crude oil. After the treatment composition was mixed into the crude oil for thirty (30) minutes the mercaptans content of the crude oil was reduced by 52%. The treated sample was allowed to continue reacting for eighty (80) hours after initial dosing and at that point the total content of mercaptans had been reduced by a total of 95% (down to 35.968 ppm).

Six other examples of the treatment process according to the first aspect and embodiment of the present invention were conducted by the inventor. In these other examples other crude oil samples Source A to Source F also having a relatively high mercaptans content were treated with the same exemplary treatment composition and at the same dosage rate (2000 ppm) as discussed in the example above. The results of the other examples are set forth in the tables and charts below.

TABLE 1

ORIGINAL COMPOSITIONS OF TEST SAMPLES

| Sample | Sulfur (%) | Mercaptans (mg/kg) | Density (g/cm$^3$) | °API Gravity |
|---|---|---|---|---|
| A | 0.3259 | 820.969 | 08034 | 44.06 |
| B | 0.1936 | 205.200 | 0.8144 | 41.73 |
| C | 0.1615 | 188.740 | 0.8147 | 41.71 |
| D | 0.2962 | 315.563 | 0.8137 | 41.92 |
| E | 0.1243 | 191.156 | 0.8070 | 43.31 |
| F | | 378.338 | | |

TABLE 2

MERCAPTANS REMOVAL TREATMENT RESULTS
(mercaptans values in mg/kg)

| Sample | | Treatment Time | | | | | | |
|---|---|---|---|---|---|---|---|---|
| | | start | 30 min | 60 min | 100 min | 145 min | 72 hr | 80 hr |
| A | mercaptan: | 820.969 | 393.757 | 329.384 | 280.557 | 222.781 | 76.701 | 35.968 |
| | reduction: | n/a | 52.04% | 59.87% | 65.83% | 72.85% | 90.66% | 95.62% |
| B | mercaptan: | 205.200 | 70.962 | | | | | 56.527 |
| | reduction: | n/a | 65.41% | | | | | 72.45% |
| C | mercaptan: | 188.740 | 92.921 | | | | | 64.703 |
| | reduction: | n/a | 50.77% | | | | | 65.72% |
| D | mercaptan: | 315.563 | 141.007 | | | | | 84.692 |
| | reduction: | n/a | 55.32% | | | | | 73.16% |
| E | mercaptan: | 191.156 | 41.164 | | | | | 32.653 |
| | reduction: | n/a | 78.47% | | | | | 82.92% |
| F | mercaptan: | 378.338 | 131.491 | | | | | |
| | reduction: | n/a | 65.25% | | | | | |

TABLE 3

ORIGINAL COMPOSITIONS OF TEST SAMPLES

| Sample | Sulfur (ppm) | Mercaptans (ppm) | Density (g/cm$^3$) | °API Gravity |
|---|---|---|---|---|
| A | 3259 | 821 | 08034 | 44.1 |
| B | 1936 | 205 | 0.8144 | 41.7 |
| C | 1615 | 189 | 0.8147 | 41.7 |
| D | 2962 | 316 | 0.8137 | 41.9 |
| E | 1243 | 191 | 0.8070 | 43.3 |
| F | | 378 | | |

TABLE 4

MERCAPTANS REMOVAL TREATMENT RESULTS
(mercaptans values in ppm)

| Sample | | Treatment Time | | | | | | |
|---|---|---|---|---|---|---|---|---|
| | | start | 30 min | 60 min | 100 min | 145 min | 72 hr | 80 hr |
| A | mercaptan: | 821 | 394 | 329 | 281 | 223 | 77 | 36 |
| | reduction: | n/a | 52% | 60% | 66% | 73% | 91% | 96% |
| B | mercaptan: | 205 | 71 | | | | | 57 |
| | reduction: | n/a | 65% | | | | | 72% |
| C | mercaptan: | 189 | 93 | | | | | 65 |
| | reduction: | n/a | 51% | | | | | 66% |
| D | mercaptan: | 316 | 141 | | | | | 85 |
| | reduction: | n/a | 55% | | | | | 73% |
| E | mercaptan: | 191 | 41 | | | | | 33 |
| | reduction: | n/a | 79% | | | | | 83% |
| F | mercaptan: | 378 | 131 | | | | | |
| | reduction: | n/a | 65% | | | | | |

It is important to note that the actual behavior of the reactions involved in the treatment process will depend on the specific conditions, concentrations, and properties of the compounds involved. Continuous monitoring and testing would be necessary to understand the rate of mercaptan reduction and the stability of the reaction over time. Although the inventor is not entirely certain why, the continued reduction of mercaptans over time in the above examples could be due to several factors, including the following:

Equilibrium Reaction: The reaction between sodium hydroxide, alcohols (methanol and 1-propanol), and mercaptans might be an equilibrium reaction. As the reaction proceeds and products are formed, the equilibrium might not be reached immediately. This could lead to the reaction continuing until equilibrium is established;

Extraction: The alcohols (methanol and 1-propanol) act as solvents to extract mercaptides (the products of mercaptan reaction with sodium hydroxide) from the crude oil. As long as there are mercaptans present in the crude oil, the extraction process can continue, leading to a gradual reduction of mercaptans over time;

Sustained Base Reaction: NaOH and KOH are strong bases that react with mercaptans, and if there remains any amount of mercaptans in the crude oil, the reaction with these hydroxides can continue, leading to ongoing reduction of mercaptans;

Catalytic Effects: Some components in the mixture, such as the terpenes (limonene), could potentially have catalytic effects on the reaction, whereby they might enhance the interaction between sodium hydroxide, alcohols, and mercaptans, leading to a prolonged reduction of mercaptans; and Slow Kinetics: The kinetics of chemical reactions can vary, and if the reaction between the components is relatively slow, it might take time for the reaction to complete and for mercaptans to be fully reduced.

Second Embodiment According to a second aspect and embodiment of the present invention, there is provided another new liquid based treatment composition which is somewhat different from the liquid composition and according to the first aspect and embodiment of the present invention, but also very effective at remediating mercaptans, and other contaminants, including hydrogen sulfide, sulfur and metals, in liquids including crude oil and distillates of crude oil. This new liquid based treatment composition also uses an organic or hydrocarbon liquid base and terpene(s) as components and is also very effective at efficiently remediating the mercaptans in liquids such as crude oil and fractions of other liquids obtained through distillation of crude oil similar to the treatment composition according to the first aspect of the present invention. A primary difference between this new treatment composition according to the second embodiment and the treatment composition according to the first embodiment is the use of at least one alkoxide rather than at least one hydroxide compound as the primary reactant for remediating the mercaptans and other targeted contaminants in contaminated liquids such as crude oil and distillates of crude oil. Some appropriate alkoxides include sodium methoxide ($CH_3NaO$), sodium ethoxide ($C_2H_5ONa$), potassium methoxide ($CH_3KO$), potassium ethoxide ($C_2H_5$ $C_2H_5KO$), etc., and combinations of two or more of these alkoxides.

The new liquid treatment composition according to the second aspect and embodiment of the present invention primarily includes at least one hydrocarbon/organic liquid as a base, together with one or more alkoxide compounds, and at least one terpene. The liquids used as the hydrocarbon liquid base and as the terpene(s) in the treatment composition may be the same as discussed herein in relation to the treatment composition according to the first aspect and embodiment of the present invention, while the alkoxide(s) may be as discussed above.

This treatment composition includes little or no water, e.g., <5 vol % and preferably no water, noting that water may react with sodium methoxide and other alkoxides thereby detracting from the reaction between the alkoxides and mercaptans, and may cause some contaminants including salts to precipitate out of the contaminated liquid being treated. Otherwise, it is generally undesirable to have any significant amount of water in crude oil and distillates of crude oil. In this treatment composition according to the second aspect and embodiment of the present invention the alkoxide compounds may be directly dissolved in the hydrocarbon liquid base, which is advantageous as the composition preferably includes no water.

The new treatment composition according to the second aspect and embodiment may contain: 50-90 vol % or wt % of organic liquid base; 1-20 wt % collectively of one or more alkoxide compound; and 5-25 vol % collectively of one or more terpene. Optionally, the treatment composition according to the second aspect of the present invention may also include a small amount of an organic acid such as fulvic acid and humic acid, e.g., 0.01 to 2.0 wt % collectively, which may help to prevent release of any precipitates from the treated liquid.

The inventor has determined that in comparison to hydroxide compounds, alkoxides exhibit superior efficacy in mitigating thiol mercaptans in crude oil and petroleum due to their heightened reactivity and specificity towards mercaptans, resulting in the formation of water soluble sodium salts. For example, if sodium methoxide is used in this new treatment composition, the sodium methoxide reacts with mercaptans in crude oil to form sodium methyl mercaptide ($CH_3SNa$), a water-soluble sodium salt, as a byproduct, while other alkoxides react with various mercaptans to form other mercaptides. This reaction involves the substitution of the hydrogen atom in the thiol molecule with a sodium atom from the sodium methoxide. Sodium mercaptide, is soluble in water due to the presence of the sodium ion, which has a strong affinity for water molecules.

Although the new treatment composition according to the second aspect and embodiment of the present invention preferably includes no water, contaminated liquids being treated such as crude oil may contain some water, e.g., ≤1 vol %, and the water in the crude oil may contain the sodium mercaptides formed by the reaction of the treatment composition and the mercaptans in the crude oil, so that the mercaptides do not precipitate out of the treated crude oil. Due to their solubility in water, sodium mercaptide and other mercaptides are also easily separable from any hydrocarbon liquid being treated, such as crude oil and distillates of crude oil. Additionally, the treatment composition according to the second aspect and embodiment of the present invention is also effective at reducing total sulfur, oxygenates and some metals, including iron and nickel, from the contaminated liquids being treated with the composition.

The inventor has also determined that while a range of alkoxide concentrations are appropriate for use in the treatment composition accord411i0ng to the second aspect of the present invention, higher concentrations of the alkoxides may provide better results. For example, a treatment composition including 80 vol % methanol and 10 vol % 1-propanol base having sodium methoxide dissolved in the base liquid at a concentration of 35% w/v and 10 vol % of limonene, resulting in a sodium methoxide concentration of more than 31 wt % for the treatment composition, demonstrates enhanced efficacy in mitigating thiols within crude oil compared to the same treatment composition using treatment compositions with lower concentrations of sodium methoxide, such as 15% or 20% w//v in the hydrocarbon base liquid. This higher concentration facilitates a more robust reaction with mercaptans leading to improved removal efficiency and overall performance.

A treatment process using the new liquid treatment composition according to the second aspect and embodiment of the present invention is very similar to the treatment process according to the liquid treatment composition according to the first aspect and embodiment of the present invention as it essentially involves adding an appropriate dosage of the new liquid treatment composition to a contaminated liquid and allowing the treatment composition to react with the mercaptans and other contaminants in the treated liquid over a period of time, e.g., a dosage rate of 5 to 4000 ppm of contaminated crude oil or other liquid being treated, with the specific amount based on the type of contaminated liquid being treated and the types and amounts of mercaptans and other contaminants to be remediated in the liquid being treated.

Some examples of a treatment composition and treatment process using these treatment compositions according to the second aspect and embodiment of the present invention are presented below in relation to Tables 5-8. The treatment process may be carried out at standard temperature and pressure, but can be carried out at any desired temperature and pressure. Because the treated liquids may contain toxic contaminants including $H_2S$, the treatment process can be carried out in an enclosed treatment chamber or other container, which may include some head space in which vapors of the toxic contaminants and other contaminants may collect. Vapors of the treatment compositions may also be released into the head space where they can react with the contaminant vapors.

Table 5 presents the results of testing done relative to a sample of liquid condensates from a natural gas/oil well, which included lower molecular weight hydrocarbon base liquids, including naptha and benzene, kerosene, etc., and which also had a relatively high mercaptans content. The specifics of the various contaminants in the condensates sample in its original form (neat) are set forth in Table 5. This condensates sample was treated with different versions of the treatment composition, i.e., L7, L8 and L9, mostly at a dosing rate of 1500 ppm, although for L7 this was used at dosing rates of 1500 ppm and 2000 ppm. The versions L7, L8 and L9 differ from each other only in relation to the organic liquid base that was used therein, i.e., L7 used a mixture containing equal amounts of methanol and n-propanol, L8 used a mixture containing equal amounts of methanol, ethanol and n-propanol, and L9 used a mixture containing equal amounts of methanol and ethanol. All of the sample versions L7. L8 and L9 used 90 vol % of the liquid organic base containing 35% wt/v sodium methoxide dissolved therein and 10 vol % of a mixture of equal amounts of r-limonene and d-limonene (terpene). The specifics of the contaminants remaining in the crude oil sample after being treated with different amounts of the three versions of the treatment composition and tested at different times after the treatment composition was added to the crude oil are set forth in Table 5. Testing results were determined using test methods UOP 163 and the trace sulfur analysis by GC/SCD using ASTM D5623-19.

TABLE 5

| | | | Initial Cylinder Test | CHEMICAL 7; 1500 ppm Dose; 1 hr | CHEMICAL 7; 1500 ppm Dose; 24 hr |
|---|---|---|---|---|---|
| | | | | Date Sampled | |
| | | | Jan. 31, 2024 | Jan. 31, 2024 | Jan. 31, 2024 |
| | | | | Parameter | |
| Sample Description | Unit | RDL | 22000310 | 22000311 | 22000314 |
| Hydrogen Sulphide | µg/g | 0.2 | 2.1 | 8.1 | 1.0 |
| Carbonyl Sulphide | µg/g | 0.2 | <0.2 | <0.2 | <0.2 |
| Methyl Mercaptan | µg/g | 0.2 | 91.7 | 28.7 | 9.9 |
| Ethyl Mercaptan | µg/g | 0.2 | 415 | 160 | 67.8 |
| Dimethyl Sulphide | µg/g | 0.2 | 13.4 | 13.3 | 14.5 |
| Carbon Disulphide | µg/g | 0.2 | <0.2 | <0.2 | <0.2 |
| iso-Propyl Mercaptan | µg/g | 0.2 | 321 | 177 | 145.0 |
| tert-Butyl Mercaptan | µg/g | 0.2 | 20.2 | 17.8 | 20.1 |
| n-Propyl Mercaptan | µg/g | 0.2 | 79.2 | 55.5 | 39.2 |
| Methyl Ethyl Sulphide | µg/g | 0.2 | 21.1 | <0.2 | 27.0 |
| s-Butyl Mercaptan | µg/g | 0.2 | 245 | 171 | 176.5 |
| Thiophene | µg/g | 0.2 | 12.2 | 14.9 | 13.3 |
| iso-Butyl Mercaptan | µg/g | 0.2 | 13.6 | <0.2 | 9.6 |
| Diethyl Sulphide | µg/g | 0.2 | 12.0 | 15.2 | 16.2 |
| n-Butyl Mercaptan | µg/g | 0.2 | 35.5 | 35.1 | 25.0 |
| tert-Butyl Methyl Sulphide | µg/g | 0.2 | 21.7 | 24.3 | 21.9 |
| Dimethyl Disulphide | µg/g | 0.2 | 3.7 | 7.5 | 4.4 |
| Diethyl Disulphide | µg/g | 0.2 | 9.7 | 19.2 | 40.4 |
| Total Unidentified Sulphur Compounds | µg/g | 0.2 | 1207 | 1327 | 1616 |
| Total Organic Sulphur | µg/g | 0.2 | 2524 | 2074 | 2247 |
| C1-C3 Mercaptans | µg/g | 0.2 | 907 | 421 | 262 |
| SAMPLE DENSITY | $kg/m^3$ | | 775.9 | | 777.4 |

| | CHEMICAL 7; 2000 ppm Dose; 24 hr | CHEMICAL 8; 1500 ppm Dose; 1 hr | CHEMICAL 8; 1500 ppm Dose; 24 hr | CHEMICAL 9; 1500 ppm Dose; 1 hr | CHEMICAL 9; 1500 ppm Dose; 24 hr |
|---|---|---|---|---|---|
| | | | Date Sampled | | |
| | Jan. 31, 2024 | Jan. 31, 2024 | Jan. 31, 2024 | | Jan. 31, 2024 |
| | | | Parameter | | |
| Sample Description | 22000317 | 22000312 | 22000315 | 22000313 | 22000316 |
| Hydrogen Sulphide | <0.2 | <0.2 | <0.2 | 2.5 | <0.2 |
| Carbonyl Sulphide | <0.2 | <0.2 | <0.2 | <0.2 | <0.2 |
| Methyl Mercaptan | 24.6 | 37.3 | 17.2 | 29.8 | <0.2 |
| Ethyl Mercaptan | 60.1 | 225 | 101.0 | 167.3 | 19.0 |
| Dimethyl Sulphide | 11.7 | 8.0 | 12.7 | 20.1 | 9.0 |
| Carbon Disulphide | <0.2 | <0.2 | <0.2 | <0.2 | <0.2 |
| iso-Propyl Mercaptan | 57.6 | 208 | 143.9 | 191.8 | 20.4 |
| tert-Butyl Mercaptan | 14.1 | 15.6 | 14.0 | 24.1 | <0.2 |
| n-Propyl Mercaptan | 17.9 | 53.9 | 30.2 | 63.5 | 5.7 |
| Methyl Ethyl Sulphide | <0.2 | 15.2 | 19.9 | 30.0 | 10.7 |
| s-Butyl Mercaptan | 71.5 | 180 | 131.0 | 187.1 | 25.8 |
| Thiophene | <0.2 | 3.5 | 9.4 | 14.9 | <0.2 |
| iso-Butyl Mercaptan | <0.2 | 3.8 | 5.1 | 12.1 | 8.4 |
| Diethyl Sulphide | 12.6 | 11.2 | 13.2 | 15.7 | 7.0 |
| n-Butyl Mercaptan | 12.3 | 24.7 | 18.7 | 36.2 | <0.2 |
| tert-Butyl Methyl Sulphide | 14.5 | 7.8 | 15.9 | 25.3 | 5.9 |

TABLE 5-continued

| | | | | | |
|---|---|---|---|---|---|
| Dimethyl Disulphide | 3.8 | 48.6 | 34.9 | 5.8 | 8.1 |
| Diethyl Disulphide | 13.5 | 18.7 | 18.6 | 30.0 | 12.5 |
| Total Unidentified Sulphur Compounds | 1271 | 406 | 470.5 | 1515 | 289.4 |
| Total Organic Sulphur | 1585 | 1267 | 1056 | 2371 | 421.7 |
| C1-C3 Mercaptans | 160 | 524 | 292 | 452 | 45.1 |
| SAMPLE DENSITY | 778.9 | | 778.8 | | 781.1 |

As seen from Table 5, the total content of C1-C3 mercaptans was significantly reduced from 907 ppm in the in the original/neat sample of condensates to: 421 ppm 1 hour after being treated with 1500 ppm dosage of the L7 composition; 262 ppm 24 hours after being treated with 1500 ppm dosage of the L7 composition; 160 ppm 24 hours after being treated with 2000 ppm dosage of the L7 composition; 524 ppm 1 hour after being treated with 1500 ppm dosage of the L8 composition; 292 ppm 24 hours after being treated with 1500 ppm dosage of the L8 composition; 452 ppm 1 hour after being treated with 1500 ppm dosage of the L9 composition; and 45.1 ppm 24 hours after being treated with 1500 ppm dosage of the L9 composition. Additionally, although there was not much $H_2S$ in the neat sample of the condensates, it was reduced to essentially zero 24 hours after being treated with each of the L7-L9 composition samples. Also, total unidentified sulfur containing compounds in the neat condensates sample were not significantly reduced using the L7 composition, but were significantly reduced by reduced by more than 50% after 24 hours with the L8 composition and by more than 75% after 24 hours with the L8 composition.

Table 6 presents the results of testing done relative to a crude oil sample having a relatively high total mercaptans content (RHS) of 2351 ppm with essentially no $H_2S$ in the liquid itself, but about 100 ppm of $H_2S$ in the vapors released from the crude oil and accumulated in a head space above the crude oil in a container in which the crude oil is disposed. This crude oil sample was treated with two different blends of the new treatment composition according to the second aspect and embodiment of the present invention, i.e., No. 11 and No. 6b. These versions of the treatment composition are the same except for the specific terpene(s) used therein, i.e., No. 11 uses r-carvone as the terpene, while No 6b uses a 50/50 blend of r-limonene and d-limonene. Otherwise, the treatment composition includes: 45 vol. % of methanol containing 30% wt/vol of sodium methoxide; 45 vol % of ethanol containing 21% wt/vol of sodium ethoxide; and 10 vol % the terpene(s). The composition No. 11 was tested at dosing rates of 2000 ppm and 3000 ppm, while the composition No. 6b was tested at a dosing rate of 3000 ppm. The levels of the contaminants remaining in the crude oil sample after being treated with different examples of the treatment composition were tested at four different times after the treatment composition was added to the crude oil sample, e.g., after about one hour, after about two hours, after about three hours, and after about two days. Testing results are set forth in Table 6. Testing results were determined using test methods UOP 163 and the trace sulfur analysis by GC/SCD using ASTM D5623-19.

TABLE 6

| Sample ID | Chemistry Used | Dosing Time | UOP 163 Results RSH\|H2S [03/01] | Titration Start Time | RSH % Reduction | H2S + RSH % Reduction | Difference Between Titration Start Time & Dosing Time | Vapor Phase H2S |
|---|---|---|---|---|---|---|---|---|
| NEAT | n/a | n/a | 2,351.236 ppm 0.000 ppm | Mar. 1, 2024 10:17:26 AM | n/a | n/a | n/a | >100 |
| BAST001.3124-2,000 ppm | No. 11 | Mar. 1, 2024 10:38:24 AM | 1,553.063 ppm 0.000 ppm | Mar. 1, 2024 11:45:11 AM | −33.95% | n/a | 1 hours 6 minutes | 0 ppm |
| BAST002.3124-3,000 ppm | No. 11 | Mar. 1, 2024 10:40:30 AM | 1,438.279 ppm 0.000 ppm | Mar. 1, 2024 11:54:09 AM | −38.83% | n/a | 1 hours 13 minutes | 0 ppm |
| BAST003.3124-3,000 ppm | No. 6b | Mar. 1, 2024 10:45:08 AM | 1,589.005 ppm 0.000 ppm | Mar. 1, 2024 12:03:51 PM | −32.42% | n/a | 1 hours 18 minutes | 0 ppm |
| BAST001.3124-2,000 ppm | No. 11 | Mar. 1, 2024 10:38:24 AM | 1,416.486 ppm 0.000 ppm | Mar. 1, 2024 12:27:12 PM | −39.76% | n/a | 1 hours 48 minutes | 0 ppm |
| BAST002.3124-3,000 ppm | No. 11 | Mar. 1, 2024 10:40:30 AM | 1,307.410 ppm 0.000 ppm | Mar. 1, 2024 12:37:55 PM | −44.39% | n/a | 1 hours 57 minutes | 0 ppm |
| BAST003.3124-3,000 ppm | No. 6b | Mar. 1, 2024 10:45:08 AM | 1,335.354 ppm 0.000 ppm | Mar. 1, 2024 12:47:35 PM | −43.21% | n/a | 2 hours 2 minutes | 0 ppm |
| BAST001.3124-2,000 ppm | No. 11 | Mar. 1, 2024 10:38:24 AM | 1,324.410 ppm 0.000 ppm | Mar. 1, 2024 1:35:07 PM | −43.67% | n/a | 2 hours 56 minutes | 0 ppm |
| BAST002.3124-3,000 ppm | No. 11 | Mar. 1, 2024 10:40:30 AM | 1,211.938 ppm 0.000 ppm | Mar. 1, 2024 1:50:29 PM | −48.46% | n/a | 3 hours 9 minutes | 0 ppm |
| BAST003.3124-3,000 ppm | No. 6b | Mar. 1, 2024 10:45:08 AM | 1,270.319 ppm 0.000 ppm | Mar. 1, 2024 2:00:03 PM | −45.97% | n/a | 3 hours 14 minutes | 0 ppm |
| BAST001.3124-2,000 ppm | No. 11 | Mar. 1, 2024 10:38:24 AM | 534.072 ppm 0.000 ppm | Mar. 4, 2024 11:18:35 AM | −77.29% | n/a | 2 days 0 hours 40 minutes | 0 ppm |

TABLE 6-continued

| Sample ID | Chemistry Used | Dosing Time | UOP 163 Results RSH\|H2S [03/01] | Titration Start Time | RSH % Reduction | H2S + RSH % Reduction | Difference Between Titration Start Time & Dosing Time | Vapor Phase H2S |
|---|---|---|---|---|---|---|---|---|
| BAST002.3124-3,000 ppm | No. 11 | Mar. 1, 2024 10:40:30 AM | 428.314 ppm 0.000 ppm | Mar. 4, 2024 11:26:20 AM | −81.78% | n/a | 2 days 0 hours 45 minutes | 0 ppm |
| BAST003.3124-3,000 ppm | No. 6b | Mar. 1, 2024 10:45:08 AM | 204.038 ppm 0.000 ppm | Mar. 4, 2024 11:34:53 AM | −91.32% | n/a | 2 days 0 hours 49 minutes | 0 ppm |

From Table 6 it can be seen that each of the treatment compositions achieved about 33% reduction in the mercaptans content after 1 hour, about 45-50% reduction in the mercaptans content after 3 hours, and 77-91% reduction in the mercaptans content after about two days and 1 hour.

Table 7 presents the results of testing done relative to a crude oil sample having a moderately high total mercaptans content (RHS) of 772 ppm with essentially no $H_2S$ in the liquid itself, but about 1000 ppm of $H_2S$ in the vapors released from the crude oil and accumulated in a head space above the crude oil in a container in which the crude oil is disposed. This crude oil sample was treated with several different blends G to M of the new treatment composition according to the second aspect and embodiment of the present invention, and were tested at different times after the treatment composition was added to the contaminated liquid. These blends of the treatment composition are the same except for the specific terpene(s) used therein, i.e., the treatment composition includes: 45 vol. % of methanol containing 30% wt/vol of sodium methoxide; 45 vol % of ethanol containing 21% wt/vol of sodium ethoxide; and 10 vol % the terpene(s), while the blends G to M respectively include 10 vol % of the following terpenes: r-carvone, linalool, r-carvone, linalool, d-limonene, linalool, d-camphor. The levels of the contaminants remaining in the crude oil sample after being treated with different the different blends of the treatment composition were tested at various different times after the treatment composition was added to the crude oil sample, e.g., after about one hour, after about three hours, after about 23 hours, and after about six days. Blends G to K were each tested after two different reaction time periods, while blends L and M were tested after only one reaction time period. All of the crude oil samples were dosed at 2000 ppm of the treatment composition, except for crude oil sample treated with the blend L, which was dosed at 3000 ppm. Testing results are set forth in Table 7. Testing results were determined using test methods UOP 163 and the trace sulfur analysis by GC/SCD using ASTM D5623-19.

TABLE 7

| SAMPLE | Treatment Chemistry And Dosing | Treatment Time days:hrs: mins | Mercaptan ppm | Mercaptan Reduction | $H_2S$ Vapor Phase ppm |
|---|---|---|---|---|---|
| Original | n/a | 0:00:00 | 772.135 | n/a | 1000 |
| G | R-Carvone | 0:00:43 | 580.171 | 24.86% | 0 |
| | 2000 ppm | 0:02:51 | 378.875 | 50.93% | 0 |
| H | Linalool | 0:00:56 | 505.545 | 34.53% | 0 |
| | 2000 ppm | 0:02:25 | 379.057 | 50.91% | 0 |
| I | R-Carvone | 0:22:15 | 206.676 | 73.23% | 0 |
| | 2000 ppm | 5:23:49 | 66.275 | 91.42% | 0 |

TABLE 7-continued

| SAMPLE | Treatment Chemistry And Dosing | Treatment Time days:hrs: mins | Mercaptan ppm | Mercaptan Reduction | $H_2S$ Vapor Phase ppm |
|---|---|---|---|---|---|
| J | Linalool | 0:22:29 | 236.711 | 69.34% | 0 |
| | 2000 ppm | 6:00:01 | 57.634 | 92.54% | 0 |
| K | High Purity | 0:22:45 | 197.511 | 74.42% | 0 |
| | Limonene 2000 ppm | 6:00:35 | 85.083 | 88.98% | 0 |
| L | Linalool 3000 ppm | 0:23:15 | 185.745 | 75.94% | 0 |
| M | D-Camphor 2000 ppm | 0:00:46 | 578.467 | 25.08% | 0 |

From Table 7 it can be seen that each of the treatment compositions achieved at least a 25% reduction in the mercaptans content after 1 hour, about 50% reduction in the mercaptans content after 3 hours, about 70 to 75% mercaptans reduction after three hours, and about 90-93% % reduction in the mercaptans content after about three days. For all of the blends of the treatment composition the vapor phase $H_2S$ was completely remediated down to 0 ppm.

Some other examples, i) to vii), of a treatment composition according to the second aspect and embodiment of the present invention are as presented below.

i) 45% vol Sodium Methoxide in Methanol (Sodium Methylate) 30% w/w
   45% vol Sodium Ethoxide in Ethanol (Sodium Ethanolate) 21% w/w
   10% vol d-Limonene
ii) 45% vol Sodium Methoxide in Methanol, 15% w/w
   45% Sodium Ethoxide in Ethanol, 10% w/w
   10% vol d-Limonene
iii) 45% vol Sodium Methoxide in Methanol 30% w/w
   44% vol Sodium Ethoxide in Ethanol 21% w/w
   10% vol d-Limonene
   1% vol n-dimethylacetamide
iv) 45% vol Sodium Methoxide in Methanol 30% w/w
   45% vol Sodium Ethoxide in Ethanol 21% w/w
   10% Menthol
v) 45% vol Sodium Methoxide in Methanol (Sodium Methylate) 30% w/w
   45% vol Sodium Ethoxide in Ethanol (Sodium Ethanolate) 21% w/w
   10% vol Menthol
vi) 45% vol Sodium Methoxide in Methanol (Sodium Methylate) 30% w/w
   45% vol Sodium Ethoxide in Ethanol (Sodium Ethanolate) 21% w/w
   10% vol Linalool
vii) 45% vol Sodium Methoxide in Methanol (Sodium Methylate) 30% w/w 45% vol Sodium Ethoxide in Ethanol (Sodium Ethanolate) 21% w/w 10% vol Myrcene In one experiment involving use of the treatment composition blend i) for treating a contaminated crude oil for remediating mercaptans, as well as total oxygenates and iron. A 2000 ppm dosage of blend i) of the treatment composition was added to the crude oil sample and results were measured 72 hours after the composition was added to the oil sample. Initially, the crude oil sample contained 44.1 parts per million weight (ppmw) total mercaptans, which was reduced by 88% to 5.3 ppmw, 7.1 ppmw total oxygenates (primarily acetaldehyde, methanol and acetone) and 8.1 ppmw iron. After treatment total mercaptans was reduced by 88% to 5.3 ppmw, total oxygenates was reduced by 48% to 3.7 ppmw, and iron was reduced by 33% to 5.7 ppmw.

In another experiment involving use of the treatment composition blends i) and ii) for remediating total sulfur, iron and nickel in two different samples of a different contaminated crude oil. The results are set forth in Table 8. The dosing rates in these examples are lower than those used for treating the other contaminated crude oil and condensate samples in the Tables 5-7 which were treated for remediating the mercaptans in the samples, e.g., the dosing rates used for remediating the sulfur, iron and nickel were from 100 to 500 ppm, whereas the dosing rates for treating the mercaptans in the contaminated liquids were from 1500 to 3000 ppm.

TABLE 8

| | Treatment Blend | Dosing Rate | Sulfur % | Iron ppm | Nickel ppm |
|---|---|---|---|---|---|
| SAMPLE 1 | | | | | |
| Original | n/a | n/a | 0.4659 | 485.0 | 7.3 |
| N | i) | 500 ppm | 0.4576 2% reduction | 224.9 54% reduction | 4.9 33% reduction |
| O | i) | 250 ppm | 0.4507 3% reduction | 224.2 54% reduction | 5.6 23% reduction |
| SAMPLE 2 | | | | | |
| Original | n/a | n/a | 0.5365 | 263.9 | 5.1 |
| P | i) | 100 ppm | 0.5373 0.15% reduction | 184.1 30% reduction | 3.7 27% reduction |
| Q | i) | 250 ppm | 0.5054 5.8% reduction | 179.3 32% reduction | 4.1 20% reduction |
| R | ii) | 100 ppm | 0.5345 0.37% reduction | 180.3 32% reduction | 4.4 14% reduction |
| S | ii) | 250 ppm | 0.5155 3.9% reduction | 180.7 32% reduction | 5.1 0% reduction |

From Table 8 it can be seen that: the treatment composition blends achieved modest sulfur reductions 0.15 to 5.8%, with higher reductions being achieved with higher dosing rates; the treatment composition blends achieved significant iron reductions 30 to 54%, with less dependence on the dosing rates; and the treatment composition blends achieved various nickel reductions 0 to 33%, with less dependence on the dosing rates, and more dependence on the particular terpene used in the treatment composition blend.

The foregoing description is given for clearness of understanding only, and no unnecessary limitations should be understood therefrom, as modifications within the scope of the invention may be apparent to those having ordinary skill in the art and are encompassed by the claims appended hereto. As one example, while the new treatment compositions according to the present invention do not require the use of organic acids such as fulvic acid and humic acid, a small collective amount, e.g., 0.1 to 2 weight %, of one or both of these organic acids may be included in the new treatment compositions in order to further prevent formation and release of any precipitates from the treated liquids.

I claim:

1. A liquid treatment composition for remediating and removing mercaptans from contaminated hydrocarbon liquids, the treatment composition comprising:

a hydrocarbon liquid;

at least one alkoxide compound; and at least one terpene, wherein the hydrocarbon liquid includes a mixture of at least two of methanol, ethanol and 1-propanol.

2. The liquid treatment composition according to claim 1, wherein a content of the at least one terpene in the liquid treatment composition is 5-25 vol %, and a content of the hydrocarbon liquid in the treatment solution is 50-90 vol %.

3. The liquid treatment composition according to claim 2, wherein the at least one alkoxide compound includes at least one of sodium methoxide and sodium ethoxide.

4. The liquid treatment composition according to claim 1, wherein the hydrocarbon liquid includes at least one of N,n-dimethylformamide (HCON(CH3)2) and dimethylacetamide ($CH_3CN(CH_3)_2$.

5. The liquid treatment composition according to claim 1, wherein the treatment composition contains no water.

6. A liquid treatment composition for remediating and removing mercaptans from contaminated hydrocarbon liquids, the treatment composition comprising:

a hydrocarbon liquid;

at least one alkoxide compound;

at least one terpene, and at least one of fulvic acid and humic acid.

7. The treatment composition according to claim 6, wherein a collective content of the at least one of fulvic acid and humic acid in the treatment composition is in a range of 0.01 to 2 wt %.

8. A treatment process for remediating and/or removing mercaptans and other contaminants from contaminated hydrocarbon liquids, comprising steps of:

adding the liquid treatment composition of claim 1 to a contaminated hydrocarbon liquid being treated at a dosage rate of 5 to 4000 parts per million (ppm) of the treatment composition/volume unit of the contaminated hydrocarbon liquid being treated; and allowing the treatment composition and the contaminated hydrocarbon liquid to react.

9. The treatment process according to claim 8, wherein step of allowing the treatment composition and the contaminated hydrocarbon liquid to react lasts for at least 30 minutes.

10. The treatment process according to claim 8, wherein the contaminated hydrocarbon liquid is crude oil, a distillate of crude oil or condensate(s) from natural gas.

11. The treatment process according to claim 8, wherein the other contaminants include sulfur, iron and nickel.

* * * * *